US008371086B1

(12) United States Patent
Shillingburg

(10) Patent No.: US 8,371,086 B1
(45) **Date of Patent: *Feb. 12, 2013**

(54) MODULAR WALL BLOCK WITH BLOCK-LOCATING JUT AND SHEAR LUG

(75) Inventor: Curtis W. Shillingburg, Rock Hill, SC (US)

(73) Assignee: RidgeRock Retaining Walls, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/428,326

(22) Filed: Mar. 23, 2012

Related U.S. Application Data

(63) Continuation of application No. 12/380,735, filed on Mar. 3, 2009, now Pat. No. 8,141,315.

(51) Int. Cl.
*E04B 1/02* (2006.01)
*E04B 1/21* (2006.01)
*E02D 5/12* (2006.01)

(52) U.S. Cl. ..... 52/603; 52/604; 52/606; 52/586.2; 52/571; 405/286

(58) Field of Classification Search ..... 52/596, 52/603, 604, 605, 606, 608, 610, 586.1, 586.2, 52/571; 404/29, 30, 34, 48; 405/262, 284, 405/286, 287
See application file for complete search history.

(56) References Cited

U.S. PATENT DOCUMENTS 3,873,225 A * 3/1975 Jakobsen et al. ..... 404/41
5,133,620 A * 7/1992 Scheiwiller ..... 404/37
5,490,363 A 2/1996 Woolford
5,503,498 A * 4/1996 Scheiwiller ..... 404/34
5,704,183 A 1/1998 Woolford
5,709,062 A 1/1998 Woolford
5,711,129 A 1/1998 Woolford
5,795,105 A 8/1998 Guth
6,471,440 B1 * 10/2002 Scheiwiller ..... 404/39
D498,543 S * 11/2004 Schmitz et al. ..... D25/113
D505,733 S * 5/2005 Castonguay et al. ..... D25/113
7,384,215 B2 6/2008 Woolford
D574,087 S * 7/2008 Bouchard ..... D25/113
D574,514 S * 8/2008 Bouchard ..... D25/113
D574,515 S * 8/2008 Bouchard ..... D25/113
D574,516 S * 8/2008 Bouchard ..... D25/113
7,575,392 B2 8/2009 Hagenah
7,845,885 B2 12/2010 Jaecklin
7,963,727 B1 6/2011 Wauhop (Continued)

FOREIGN PATENT DOCUMENTS

CA 2438565 A1 * 2/2005
GB 2123877 A * 2/1984

(Continued)

*Primary Examiner* — Basil Katcheves
*Assistant Examiner* — Rodney Mintz
(74) *Attorney, Agent, or Firm* — Schwartz Law Firm, P.C.

(57) ABSTRACT

A modular wall block is adapted for being assembled together with a number of other blocks in stacked courses to form a retaining wall. The wall block has a front and rear, top and bottom, and opposing sides. The top and bottom define respective substantially planar stacking surfaces. A shear lug projects from one of the planar stacking surfaces of the top and bottom. A block-locating jut is formed with at least one of the opposing sides, and projects from the side at a point intermediate the top and bottom towards one of the planar stacking surfaces. The block-locating jut defines a base surface substantially coplaner with the stacking surface, and a lug-engaging shoulder adapted for engaging a shear lug of a wall block located in an adjacent stacked course.

14 Claims, 7 Drawing Sheets

U.S. PATENT DOCUMENTS

| | | | | |
|---|---|---|---|---|
| 8,011,152 | B2 | 9/2011 | Thomassen | |
| 8,074,419 | B1 | 12/2011 | Humphress et al. | |
| 8,141,315 | B1 * | 3/2012 | Shillingburg | 52/603 |
| 8,266,855 | B1 * | 9/2012 | Altararwah | 52/284 |
| 8,291,669 | B2 * | 10/2012 | Karau | 52/609 |
| 2004/0088929 | A1 * | 5/2004 | Dawson et al. | 52/102 |
| 2006/0239784 | A1 * | 10/2006 | Price et al. | 405/284 |
| 2007/0269264 | A1 * | 11/2007 | Boghossian | 404/19 |
| 2009/0249734 | A1 * | 10/2009 | Karau | 52/604 |
| 2011/0318100 | A1 | 12/2011 | Rainey | |
| 2012/0020730 | A1 | 1/2012 | Chow | |

FOREIGN PATENT DOCUMENTS

JP 07286301 A * 10/1995

* cited by examiner

MODULAR WALL BLOCK WITH BLOCK-LOCATING JUT AND SHEAR LUG

TECHNICAL FIELD AND BACKGROUND OF INVENTION

This disclosure relates broadly to a modular wall block, and a retaining wall constructed of an assembly of such blocks in stacked courses. In one exemplary implementation, the exemplary wall block described herein is applicable for landscaping around residential and commercial structures to retain and preserve the surrounding soil while promoting the aesthetics of the area.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, the disclosure may comprise a modular wall block adapted for being assembled together with a number of other blocks in stacked courses to form a retaining wall. The exemplary wall block comprises a front and rear, top and bottom, and opposing sides. The top and bottom define respective substantially planar stacking surfaces. A shear lug projects from one of the planar stacking surfaces of the top and bottom. A block-locating jut is formed with at least one of the opposing sides, and projects from the side at a point intermediate the top and bottom towards one of the planar stacking surfaces. The block-locating jut defines a base surface substantially coplaner with the stacking surface, and a lug-engaging shoulder adapted for engaging a shear lug of a wall block located in an adjacent stacked course.

As used herein, the base surface of the block-locating jut is substantially coplaner with the stacking surface of the wall block when the lug-engaging shoulder effectively and operably engages a shear lug of a wall block in an adjacent stacked course.

According to another exemplary embodiment, the block-locating jut defines a plurality of converging planar surfaces.

According to another exemplary embodiment, the converging planar surfaces of the block-locating jut intersect at an apex proximate the stacking surface.

According to another exemplary embodiment, the front, rear, and opposing sides define a hollow center portion of the wall block.

According to another exemplary embodiment, the opposing sides angle inwardly from the front to the rear.

According to another exemplary embodiment, the front of the wall block defines a block face comprising spaced-apart vertical breaks defining a center face portion and opposing side face portions.

According to another exemplary embodiment, the lug-engaging shoulder extends substantially parallel to the center face portion of the front.

According to another exemplary embodiment, the shear lug is integrally formed with the wall block adjacent the rear.

According to another exemplary embodiment, at least one of the opposing sides defines a generally L-shaped vertical slot.

According to another exemplary embodiment, a mechanical course connector is received in the L-shaped vertical slot formed with the side.

In another exemplary embodiment, the disclosure comprises a wall block adapted for being assembled together with a number of other blocks in stacked courses to form a retaining wall. The wall block has a front and rear, top and bottom, and opposing sides. The top and bottom define respective substantially planar stacking surfaces. A shear lug projects from one of the stacking surfaces of the top and bottom. First and second block-locating juts are formed with respective opposing sides. Each of the block-locating juts projects from the side (e.g., at a point intermediate the top and bottom) towards the planar stacking surface opposite the shear lug. Each of the block-locating juts defines a base surface substantially coplaner with the stacking surface, and a lug-engaging shoulder adapted for engaging a shear lug of a wall block located in an adjacent stacked course.

In yet another exemplary embodiment, the disclosure comprises a retaining wall constructed of an assembly of modular wall blocks, as described herein, arranged in stacked courses.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterite) is not intended to indicate or imply that the invention has been previously reduced to practice or that any testing has been performed.

Figure 1:
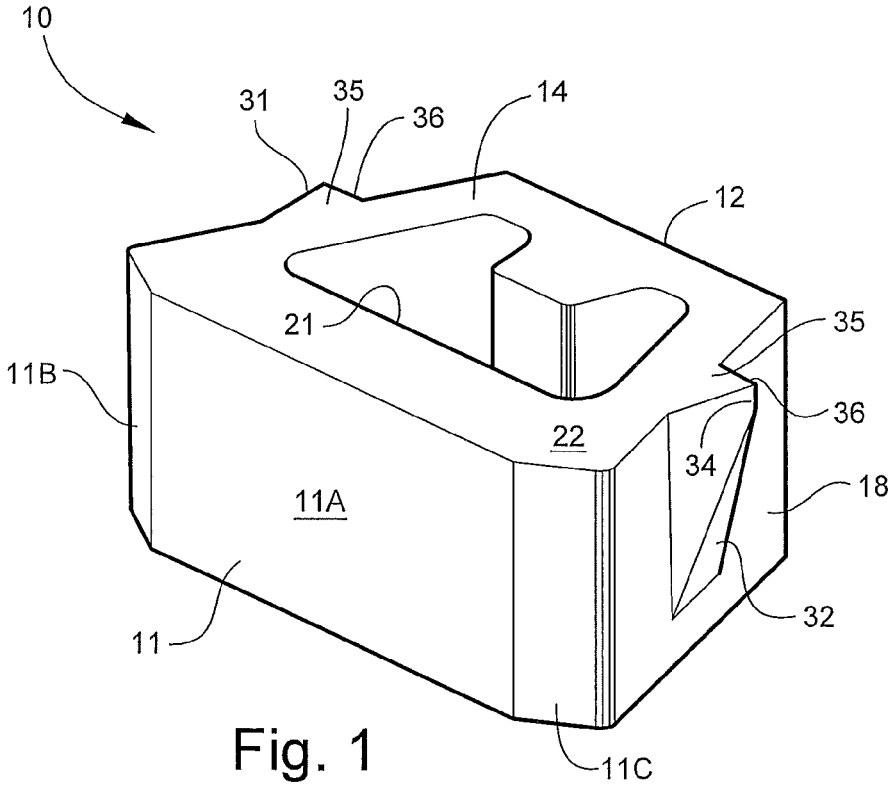
FIG. 1 is a perspective view of a modular wall block according to one exemplary embodiment of the present disclosure.
Figure 2:
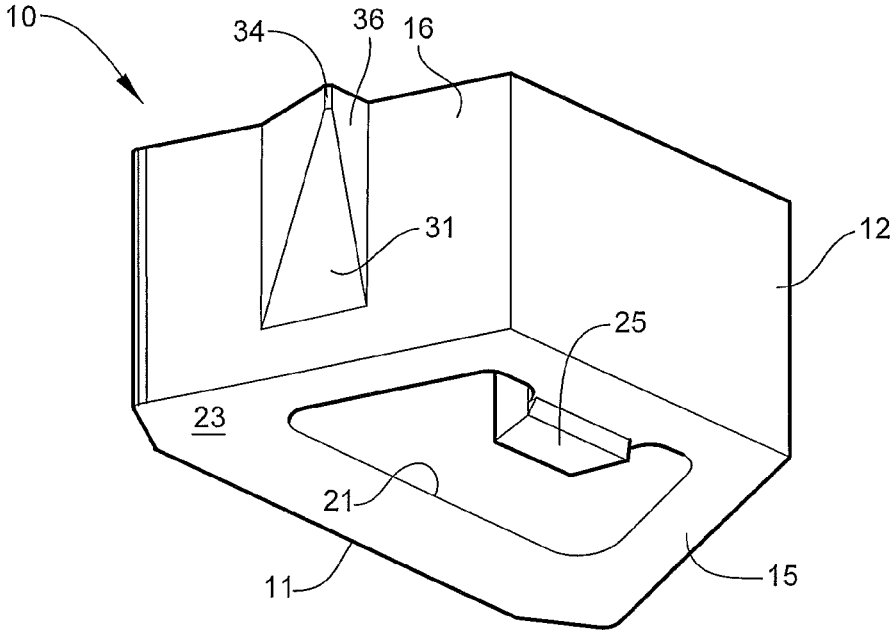
FIG. 2 is a second perspective view of the exemplary wall block.
Figure 3:
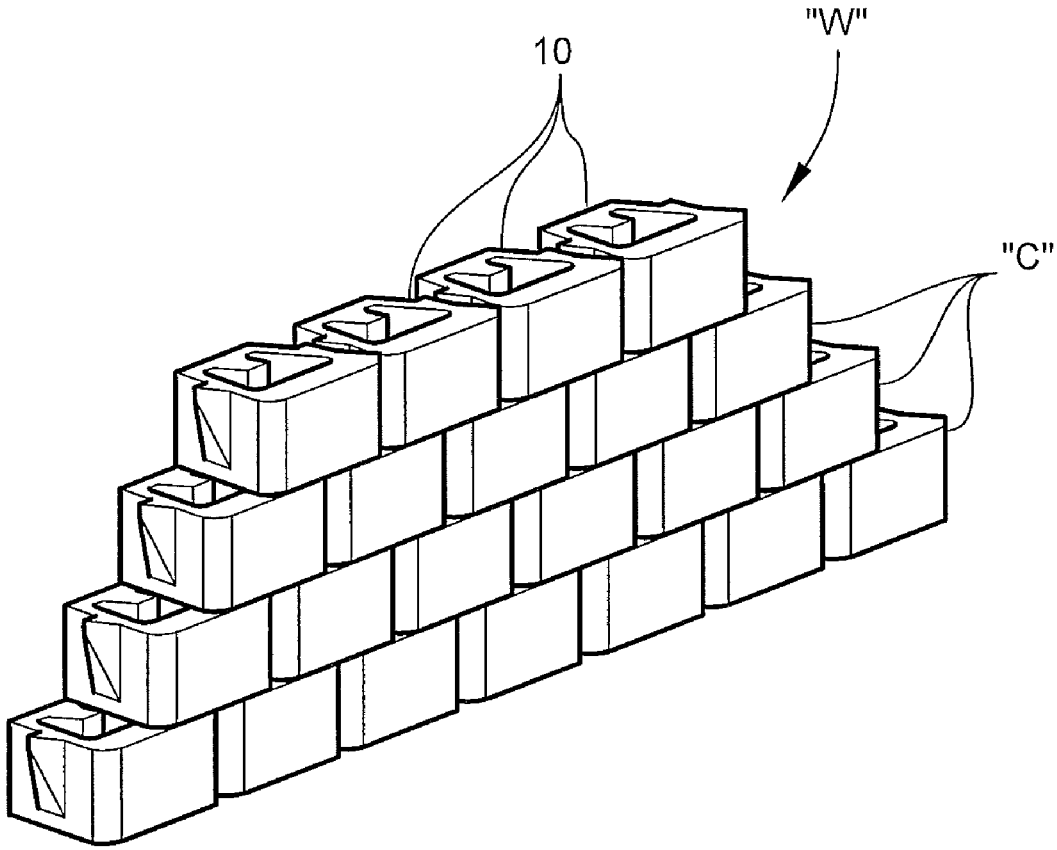
FIG. 3 is a perspective view of a partially completed retaining wall constructed of an assembly of exemplary wall blocks.

Referring now specifically to the drawings, a modular wall block according to one exemplary embodiment of the present invention is illustrated in FIGS. 1 and 2, and shown generally at reference numeral 10. The exemplary wall block 10 is adapted for being assembled, as shown in FIG. 3, together with a number of like blocks in stacked courses "C" to form a retaining wall "W". The wall blocks may be formed of any suitable material including, for example, molded masonry concrete.

Figure 4:
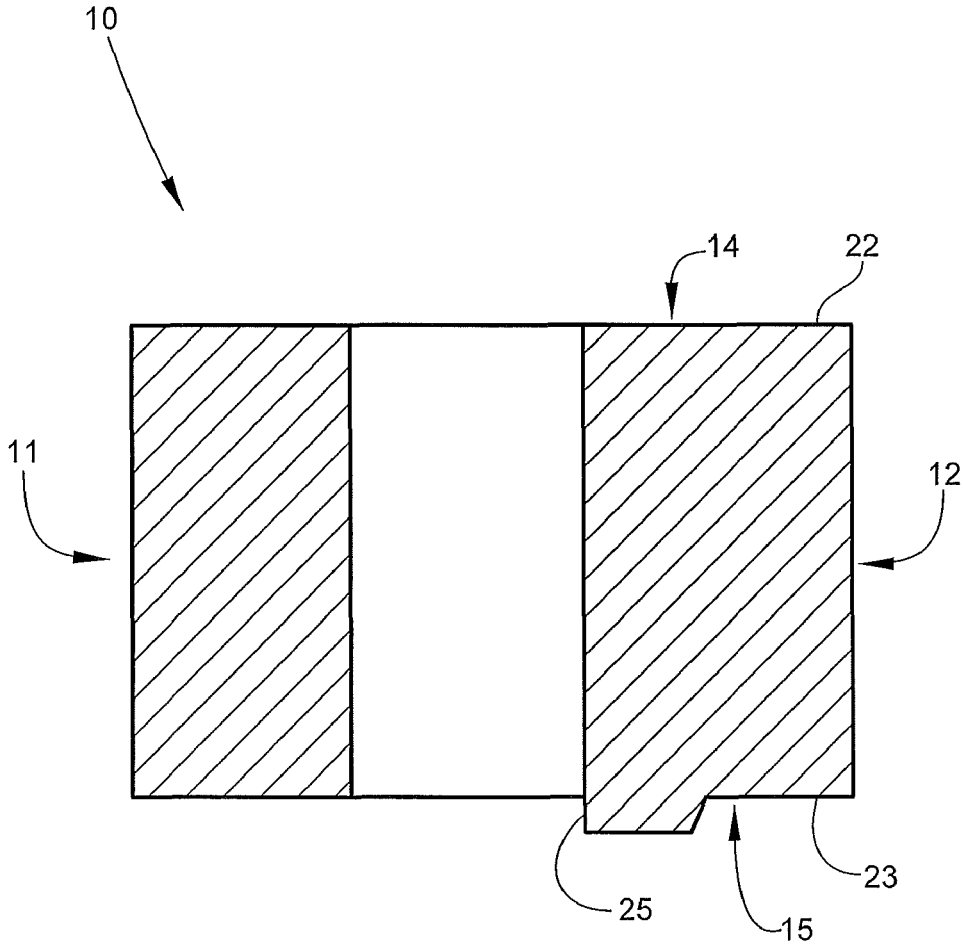
FIG. 4 is a cross-sectional view of the exemplary wall block.

As best shown in FIGS. 1 and 2, the exemplary wall block 10 has a front and rear 11, 12, top and bottom 14, 15, and opposing inwardly angled sides 16, 18. In the present exemplary embodiment, the front 11 includes vertical breaks defining a center face portion 11A and opposing side face portions 11B, 11C. The center face portion 11A may have an aesthetic, unfinished, rough textured surface. The core 21 of the wall block 10 may be substantially hollow to reduce the overall weight of the block, and for convenient handling and placement of the block during construction of the retaining wall "W" or other structure. The top and bottom 14, 15 define respective substantially planar stacking surfaces 22, 23. An integrally-formed shear lug 25, shown in FIGS. 1 and 4, is located proximate the rear 12 of the wall block 10 and projects from the stacking surface 23 of the bottom 15. Alternatively, the shear lug 25 may project from the stacking surface 22 of the top 14, or from both stacking surfaces of the top and bottom 14, 15.

Respective identical block-locating juts 31, 32 are integrally-formed with opposing sides 16, 18 of the wall block 10, and project from each side at a point intermediate the top and bottom 14, 15 towards the planar stacking surface 22 opposite the shear lug 25. In the exemplary embodiment, each block-locating jut 31, 32 is defined by a plurality of converging planar and substantially triangular surfaces which intersect at an apex 34 proximate the stacking surface 22. Each jut 31, 32 has a base surface 35 substantially coplaner with the stacking surface 22, and a substantially triangular lug-engaging shoulder 36 adapted for engaging a shear lug of a wall block located in an adjacent stacked course. See FIG. 5. At the apex 34, the lug-engaging shoulder 36 may project between 0.25 and 2.00 inches beyond the side 16, 18 of the wall block, and may extend substantially parallel to the center face portion 11A of the block front 11.

Figure 5:
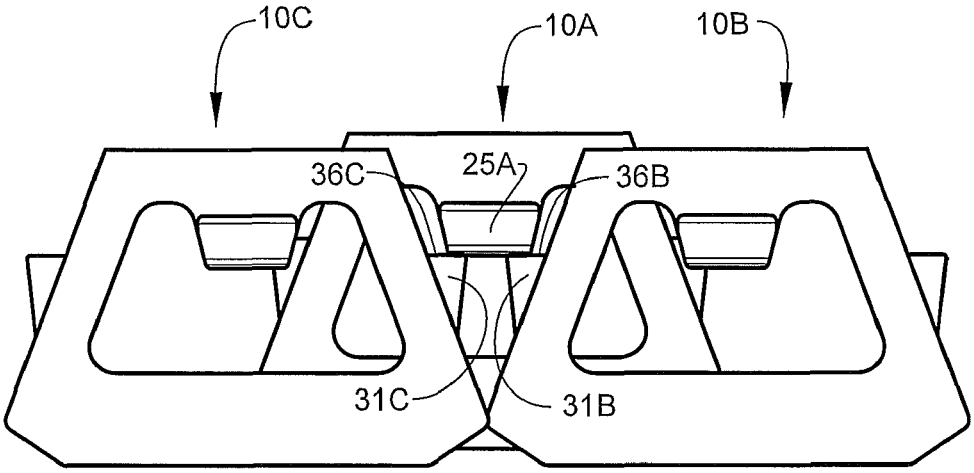
FIG. 5 is a bottom plan view of three stacked wall blocks illustrating cooperative engagement of the block-locating juts and shear lug.

As demonstrated in FIG. 5, the block-locating juts and shear lugs of adjacent stacked courses cooperate to vertically register and align the wall blocks 10A, 10B, and 10C in the retaining wall. Wall block 10A resides in an upper course stacked upon wall blocks 10B, 10C in the adjacent lower course. In this arrangement, the lug-engaging shoulders 36B, 36C of respective juts 31B, 31C bear directly against the downward projecting shear lug 25A of the upper course wall block 10A. Other blocks (not shown) in the upper and lower courses are assembled in a similar manner in constructing the retaining wall "W" shown in FIG. 3.

Figure 6:
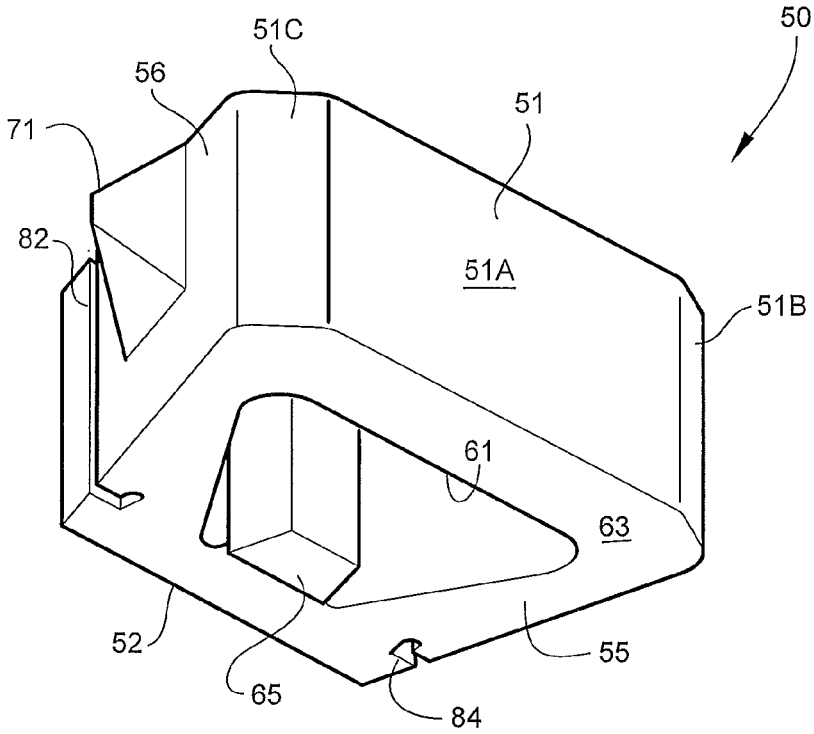
FIG. 6 is a perspective view of a modular wall block according to a further exemplary embodiment of the present disclosure.
Figure 7:
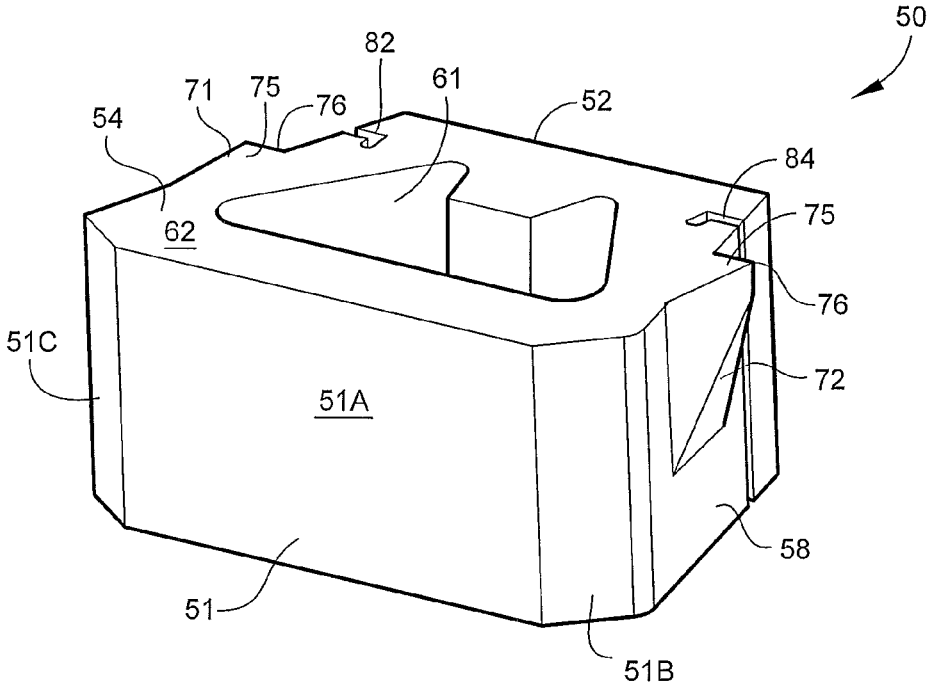
FIG. 7 is another perspective view of the exemplary wall block.
Figure 8:
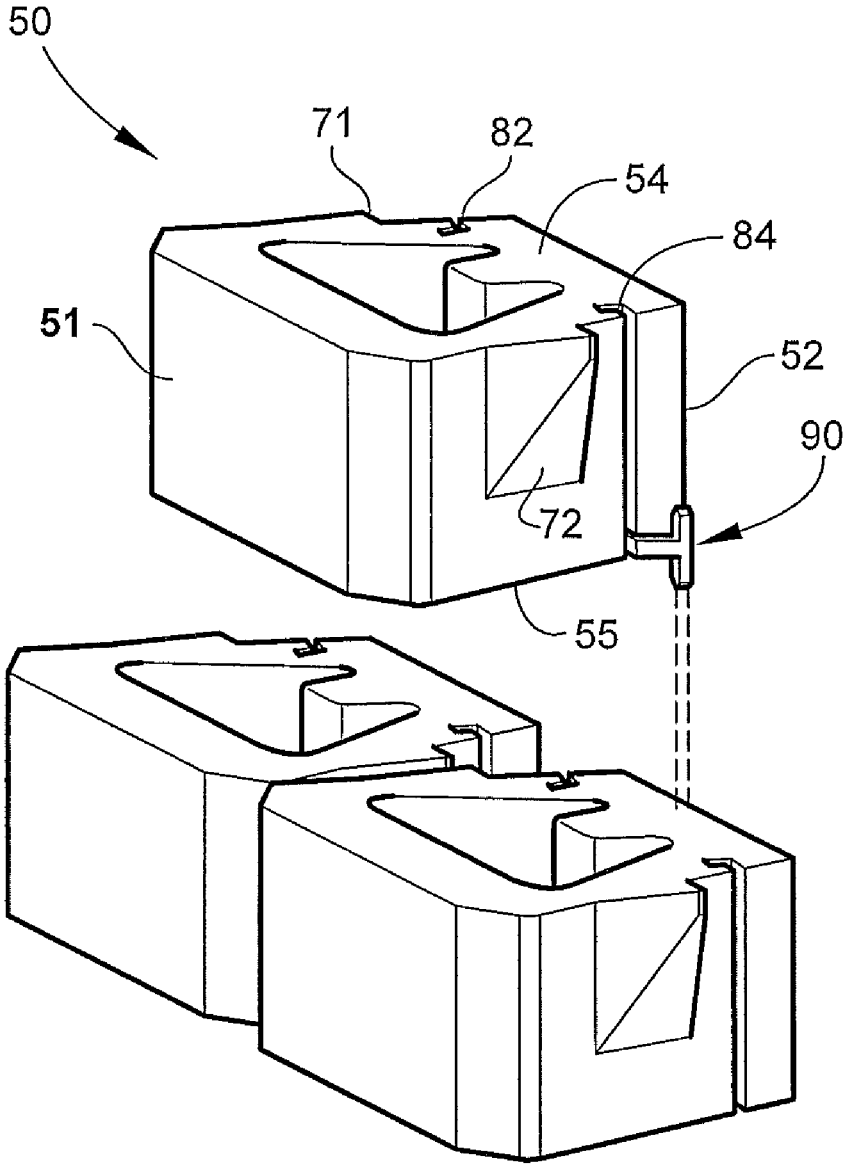
FIG. 8 is a perspective view showing multiple wall blocks to demonstrate use of the mechanical course connector.

Another exemplary embodiment of a modular wall block 50 is shown in FIGS. 6, 7, and 8. Like wall block 10, the wall block 50 has a front and rear 51, 52, top and bottom 54, 55, and opposing inwardly angled sides 56, 58. The front 51 includes vertical breaks defining a center face portion 51A and opposing side face portions 51B, 51C. The core 61 of the wall block 50 may be substantially hollow, while the top and bottom 54, 55 define respective substantially planar stacking surfaces 62, 63. An integrally-formed shear lug 65, such as that previously described, is located proximate the rear 52 of the wall block 50 and projects from the stacking surface 63 of the bottom 55. Respective identical block-locating juts 71, 72, such as that previously described, are integrally-formed with opposing sides 56, 58 of the wall block 50, and project from each side at a point intermediate the top and bottom 54, 55 towards the planar stacking surface 62 opposite the shear lug 65. Each jut 71, 72 has a base surface 75 substantially coplaner with the stacking surface 62, and a lug-engaging shoulder 76 adapted for engaging a shear lug of a wall block located in an adjacent stacked course.

In this exemplary embodiment, the sides 56, 58 of the wall block 50 define respective vertical, L-shaped slots 82, 84 extending through the wall block 50 from the top to the bottom 54, 55. As demonstrated in FIG. 8, the vertical slots 82, 84 are designed to receive mechanical course connectors 90 (only one shown), described below, which operate to conveniently position, align, and secure the wall blocks in the retaining wall. Alternatively, the vertical slots may extend only partially through the wall block. Use of mechanical course connectors in a retaining wall is further described in prior U.S. Pat. No. 6,701,687 owned by Ridgerock Retaining Walls, Inc. of Charlotte, N.C.; the complete disclosure of which is incorporated by reference herein.

Figure 9:
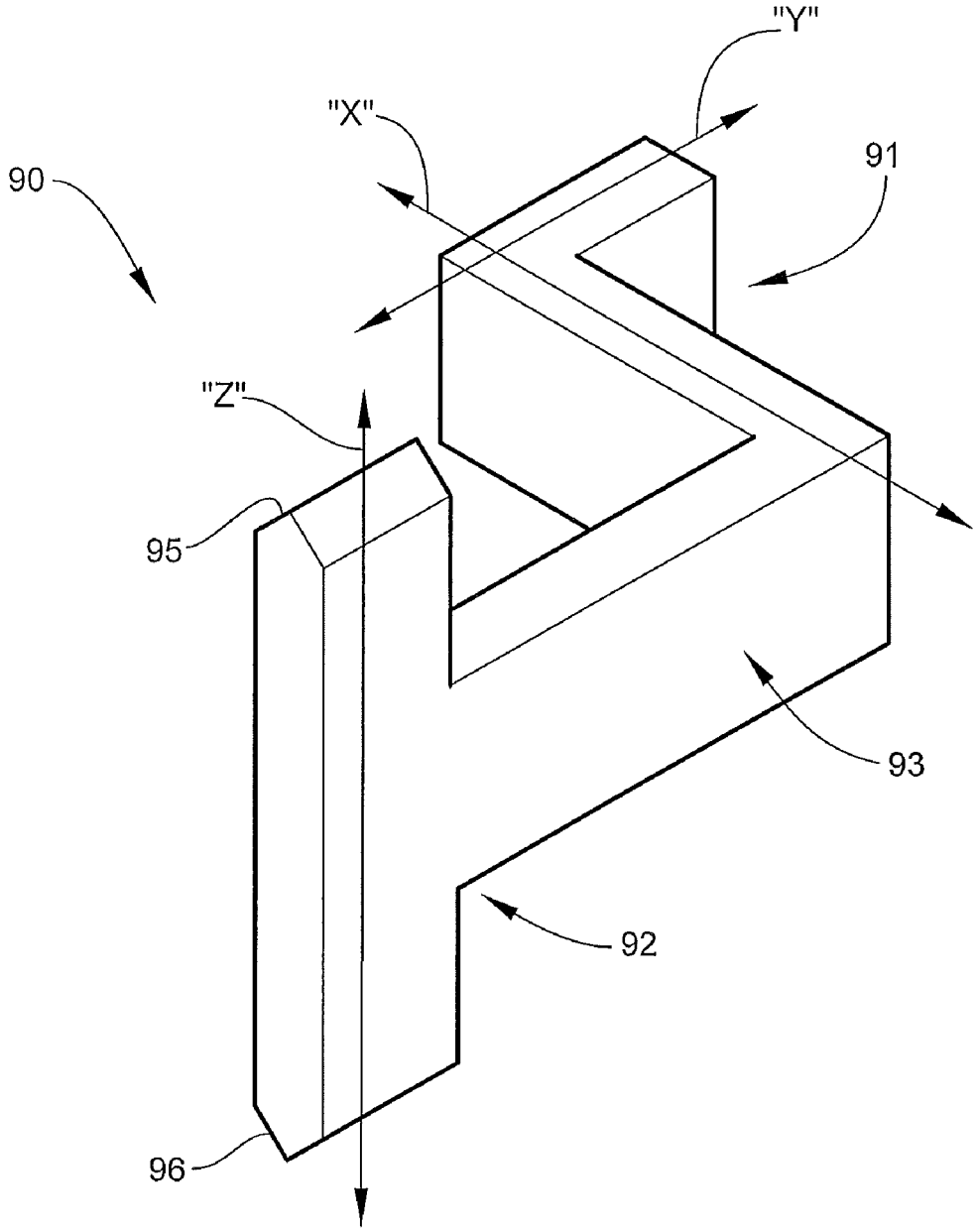
FIG. 9 is an enlarged perspective view of the mechanical course connector.

A single course connector 90 is illustrated in FIG. 9. The course connector 90 may be molded of a glass-filled nylon, and includes first and second ends 91, 92 integrally joined together by a setback spacer 93. The first end 91 extends in both an x-direction and y-direction, as indicated at "X" and "Y', respectively, and defines a generally L-shaped structure which is received in the corresponding vertical slot 82, 84 of the wall block 50. When properly positioned in the vertical slot 82, 84 movement of the course connector 90 is restricted in all directions except upwardly towards the top 54 of the block and downwardly towards the bottom 55. The elongated setback spacer 93 is integrally formed with the first end 91 of the course connector 90, and extends in a direction perpendicular to the x-direction "X" of the first end 91 and parallel to the y-direction "Y" of the first end 91.

The opposite end of the setback spacer 93 is integrally formed with the second end 92 of the course connector 90. The second end 92 extends perpendicular to the setback spacer 93 in a z-direction indicated at "Z". The second end 92 comprises a vertical spike with opposing pointed ends 95, 96. When the blocks 50 are assembled in the retaining wall one of the spike ends 95, 96 projects outwardly beyond the bottom 55 of the wall block 50 to engage one of the other stacked blocks in a lower course. The setback spacer 93 locates the vertical spike of the second end 92 a spaced distance from the first end 91 of the course connector 90 to position the wall block 50 in the retaining wall relative to the other blocks in the upper and lower course. The degree of setback is controlled by the length of the spacer 93. For example, a relatively short setback spacer 93 will result in greater setback from one stacked course to the next. A longer setback spacer 93 will result in less setback.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. A modular wall block adapted for being assembled together with a number of other blocks in stacked courses to form a retaining wall, said wall block comprising:

a front and rear, top and bottom, and opposing sides, said top and bottom defining respective substantially planar stacking surfaces;

a shear lug projecting from one of said planar stacking surfaces of said top and bottom;

a block-locating jut formed with at least one of said opposing sides, and comprising a plurality of converging planar surfaces projecting from said side beginning at a point intermediate said top and bottom, and extending at an outward angle towards one of said planar stacking surfaces, and said converging planar surfaces intersecting at an apex spaced apart from said side beginning at said point intermediate said top and bottom, and said apex is substantially co-planar to one of said stacking surfaces; and said block-locating jut further defining a lug-engaging shoulder adapted for engaging a shear lug of a wall block located in an adjacent stacked course.

2. The modular wall block according to claim 1, wherein said opposing sides angle inwardly from said front to said rear.

3. The modular wall block according to claim 1, wherein said shear lug is integrally formed with said wall block adjacent said rear.

4. The modular wall block according to claim 1, wherein said front of said wall block defines a block face comprising spaced-apart vertical breaks defining a center face portion and opposing side face portions.

5. The modular wall block according to claim 4, wherein said lug-engaging shoulder extends substantially parallel to the center face portion of said front.

6. The modular wall block according to claim 1, wherein at least one of said opposing sides defines a slot.

7. The modular wall block according to claim 6, further comprising a mechanical course connector received in the slot formed with said side.

8. A modular wall block adapted for being assembled together with a number of other blocks in stacked courses to form a retaining wall, said wall block comprising:

a front and rear, top and bottom, and opposing sides, said top and bottom defining respective substantially planar stacking surfaces;

a shear lug projecting from one of said stacking surfaces of said top and bottom;

a first and second block-locating juts formed with respective opposing sides, and each of said block-locating juts comprising a plurality of converging planar surfaces projecting from said side beginning at a point intermediate said top and bottom and extending at an outward angle towards said planar stacking surface opposite said shear lug, and said converging planar surfaces intersecting at an apex spaced apart from said side beginning at said point intermediate said top and bottom, and said apex is substantially co-planar to said stacking surface opposite said shear lug; and each of said block-locating juts further defining a lug-engaging shoulder adapted for engaging a shear lug of a wall block located in an adjacent stacked course.

9. A retaining wall constructed of an assembly of modular wall blocks arranged in stacked courses, each of said wall blocks comprising:

a front and rear, top and bottom, and opposing sides, said top and bottom defining respective substantially planar stacking surfaces;

a shear lug projecting from one of said stacking surfaces of said top and bottom;

a block-locating jut formed with at least one of said opposing sides, and comprising a plurality of converging planar surfaces projecting from said side beginning at a point intermediate said top and bottom, and extending at an outward angle towards one of said planar stacking surfaces, and said converging planar surfaces intersecting at an apex spaced apart from said side beginning at said point intermediate said top and bottom, and said apex is substantially co-planar to one of said stacking surfaces; and said block-locating jut further defining a base surface and a lug-engaging shoulder adapted for engaging a shear lug of a wall block located in an adjacent stacked course.

10. The retaining wall according to claim 9, wherein said opposing sides of said wall block angle inwardly from said front to said rear.

11. The retaining wall according to claim 9, wherein said shear lug is integrally formed with said wall block adjacent said rear.

12. The retaining wall according to claim 9, further comprising at least one course connector for mechanically interconnecting adjacent stacked courses of said wall blocks.

13. The retaining wall according to claim 9, wherein said front of said wall block defines a block face comprising spaced-apart vertical breaks defining a center face portion and opposing side face portions.

14. The retaining wall according to claim 13, wherein said lug-engaging shoulder extends substantially parallel to the center face portion of said front of said wall block.

* * * * *